United States Patent [19]

Denker et al.

[11] 4,309,269

[45] Jan. 5, 1982

[54] COAL-OIL SLURRY PIPELINE PROCESS

[75] Inventors: Bernard L. Denker, Key Biscayne, Fla.; Peter Maruhnic, Pennington, N.J.

[73] Assignee: Hydrocarbon Research, Inc., Lawrenceville, N.J.

[21] Appl. No.: 43,856

[22] Filed: May 30, 1979

[51] Int. Cl.[3] ..... C10G 1/00; C10G 1/06; C10L 1/32; C10L 1/14

[52] U.S. Cl. ..... 208/8 LE; 208/8 R; 208/10; 406/197; 406/47; 406/48; 406/49; 44/51; 44/63; 137/51

[58] Field of Search ..... 208/8 LE, 8, 10; 406/47, 48, 49, 197; 44/51, 63; 137/51

[56] References Cited

U.S. PATENT DOCUMENTS

| | | | |
|---|---|---|---|
| 2,610,900 | 9/1952 | Cross | 406/48 |
| 3,129,164 | 4/1964 | Cameron | 208/370 |
| 4,054,504 | 10/1977 | Chervenak et al. | 208/10 |
| 4,136,013 | 1/1979 | Moll et al. | 208/10 |

OTHER PUBLICATIONS

Slurry Transportation Bibliography, Slurry Tran. Assoc., 490 L'Enfant Plaza East, S.W., Suite 3210, Wash., D.C.

Chemical Eng., vol. 68, p. 55, Sep. 1961, "Oil or a Carrier for Coal in a Long Distance Pipeline".

*Primary Examiner*—Curtis R. Davis
*Assistant Examiner*—William G. Wright
*Attorney, Agent, or Firm*—Vincent A. Mallare; Fred A. Wilson

[57] ABSTRACT

A process for conveniently transporting particulate coal and crude oil together as a slurry through a pipeline. The coal, having particle size of 20–350 mesh size range, is added to the oil in sufficient amount to form a transportable coal-oil slurry. The slurry is maintained at sufficient velocity and turbulence in the pipeline to prevent solids settling, and also at sufficient pressure, temperature, and time conditions to liquify at least 5 weight percent of the coal. Also, when the sulfur content of the coal used is less than the oil, the sulfur content of the delivered oil portion is reduced during its transit through the pipeline. At its destination, the oil portion can be separated from the slurry and passed to refining operations, while the coal along with some contained heavy oil can be either liquefied to produce hydrocarbon liquid fuel products, or burned as fuel in a power plant.

13 Claims, 1 Drawing Figure

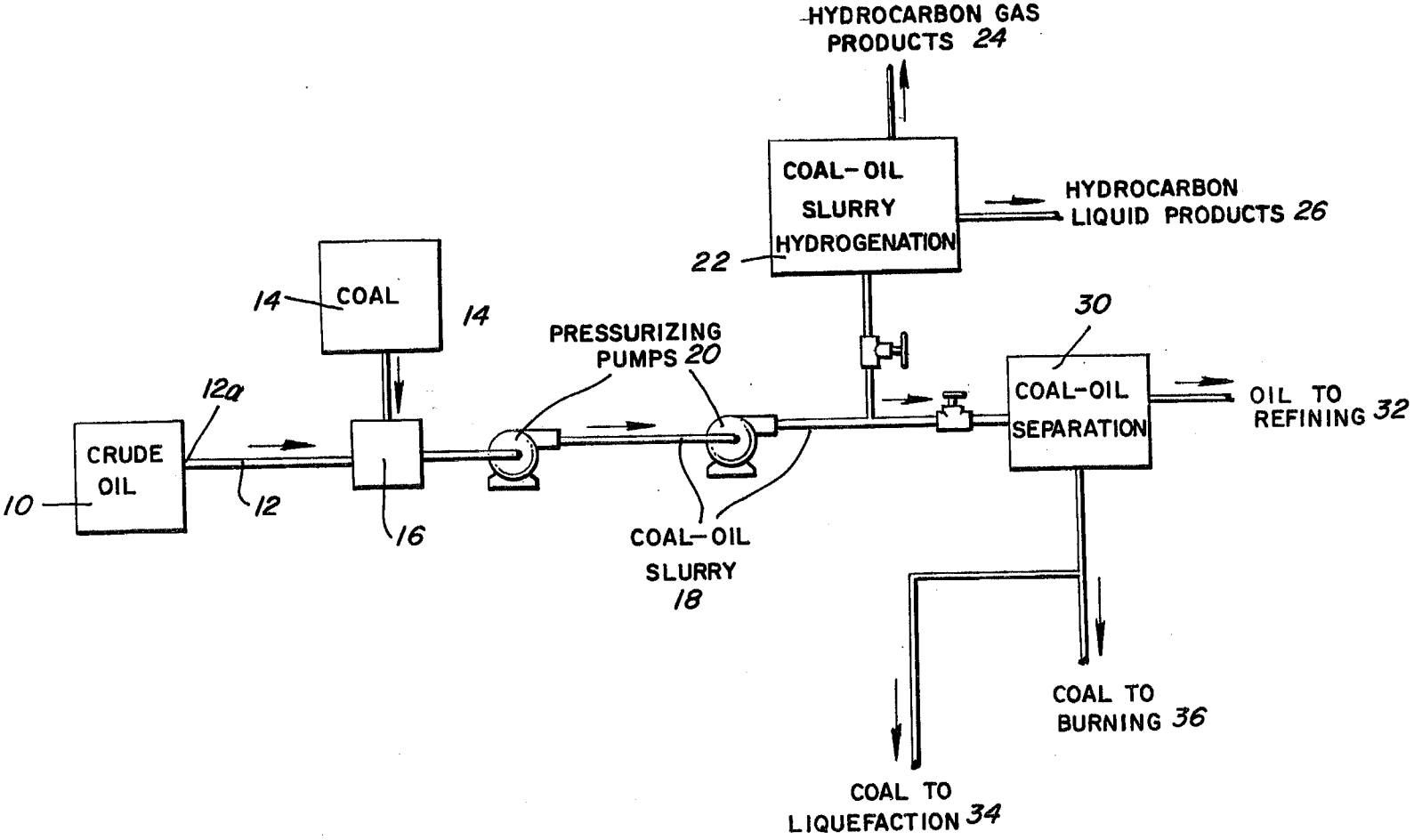
HYDROCARBON GAS PRODUCTS 24
HYDROCARBON LIQUID PRODUCTS 26
COAL-OIL SLURRY HYDROGENATION
22
30
COAL-OIL SEPARATION
OIL TO REFINING 32
COAL TO BURNING 36
COAL TO LIQUEFACTION 34
PRESSURIZING PUMPS 20
COAL-OIL SLURRY 18
14
COAL
14
16
12
12a
CRUDE OIL
10

COAL-OIL SLURRY PIPELINE PROCESS

BACKGROUND OF THE INVENTION

1. Field of the Invention

This invention pertains to transporting particulate coal through a pipeline as a coal-oil slurry, and particularly to coal-oil slurry pipelines in which crude oil is the slurrying liquid and a useful degree of coal liquefaction occurs during its passage through the pipeline at the existing elevated temperature and pressure conditions.

2. Description of Prior Art

It is apparent that coal will become increasingly prominent as a source of fossil fuel energy in the United States in the future, and thus the volume of coal to be transported from mining regions to points of usage will also be increased. The advantages and technology for transporting coal through pipelines as coal-water slurries are well known, and several patents have issued pertaining to such pipelines. However, in many regions where abundant coal exists, particularly in the western United States, water is not in abundant supply and therefore is not usually available for use in coal transportation via coal-water slurry pipelines. Also, even if water supply is plentiful in the same general area as coal supplies, the water used becomes contaminated during pipeline transportation by impurities in the coal, such as sulfur and iron, resulting in a water treatment or reclamation problem at the termination of the coal-water transportation pipeline.

To overcome these disadvantages of coal-water slurry pipelines for transporting coal, the present inventors have proposed using a coal-oil slurry wherein oil is the slurrying liquid for the coal. Specifically, the major deposits of coal which exist in the western part of the United States suggest that increasingly more of this coal will be moving from west to east. This condition, when coupled with the potential of more Alaskan crude oil or oil products also moving from west coast ports to markets in the mid-west area and passing near abundant coal reserves, makes a coal-oil slurry pipeline feasible and economically attractive. Thus as an example, the same pipeline could be used for transporting both Alaskan crude oil traveling eastward to refineries and western coals to the mid-western markets, and useful hydrocarbon reactions accomplished during transit of such coal-oil slurries through the pipeline.

The general use of coal-oil pipelines for transporting coal have been previously proposed, as disclosed in U.S. Pat. No. 2,128,913 to Burk and U.S. Pat. No. 2,610,900 to Cross. Also, U.S. Pat. No. 3,210,168 to Morway discloses use of a stabilized slurry of pulverized coal coated with liquid hydrocarbon fuel and slurried in water for pumping through pipelines. However, none of these patents proposed accomplishing any useful liquefaction and/or hydrogenation reaction of the coal during its transit through a coal-oil slurry pipeline.

SUMMARY OF THE INVENTION

This invention discloses a coal-oil slurry pipeline process for transporting particulate coal and a hydrocarbon oil together as a slurry over considerable distances. It discloses more particularly a coal-oil slurry pipeline process in which crude oil is used as the slurrying liquid for the particulate coal, and wherein a significant degree of coal liquefaction and/or hydrogenation reaction occurs during its transit through the pipeline while at the existing pipeline elevated temperature and pressure conditions therein.

It is an important feature of this invention that the coal is not only slurried and transported by oil, but also the coal-oil contact in the pipeline during the transit time, temperature and pressure reaction conditions upgrades the coal by achieving at least a moderate degree of liquefaction and hydrogenation. The fluid friction resulting from the coal-oil slurry being pumped through the pipeline not only produces a significant degree of turbulence which helps maintain the coal particles in suspension, but also produces considerable heating of the slurry. The slurry flows at average linear velocities exceeding about 5 ft/sec and can be up to about 50 ft/sec., which causes considerable fluid friction heating with the result that the coal-oil slurry attains temperatures of at least about 350° F. and preferably 400°–600° F. The coal-oil slurry residence time in the pipeline, which may extend for 500–1000 miles, will be at least about 15 hours and is preferably 20–200 hours. The slurry total pressure is at least about 50 psig and is usually 200–1000 psig. It has been found that at least about 5 weight percent and usually 10–50 weight percent of the coal introduced into the coal-oil slurry pipeline is liquefied before it reaches its destination, due to the time, pressure and temperature reaction conditions present in the pipeline.

Although suggestions for transporting coal-oil slurries via pipeline have been made before, the present process provides for long residence times and increased temperatures and pressure conditions in the pipeline, and thereby provides an interaction between the coal and oil whereby the oil donates hydrogen to the coal causing a portion of the coal to become soluble. Furthermore, when the coal being transported is low in sulfur concentration compared to the oil, such as containing less than about three weight percent sulfur, the liquefied coal portion serves to reduce the sulfur content of the oil portion during transit of the coal-oil slurry through the pipeline.

As an alternative step to obtain increased reaction of the coal while in the pipeline, a small amount of catalyst may be added to the coal-oil slurry. Although particulate catalyst of any size smaller than about 1/16 inch diameter may be added with the coal, fine bead type catalyst having particle size smaller than about 0.020 inch diameter is preferred. Such fine catalyst is not only more reactive due to its higher surface area per unit weight, but it may conveniently remain with the coal-oil slurry when it is further processed at the pipeline terminal end.

When the coal-oil slurry reaches its destination, it can be removed from the pipeline and further hydrogenated in a catalytic reaction process to produce lower boiling hydrocarbon liquids. Alternatively, the remaining particulate coal portion may be separated from the oil portion by the use of suitable separation means, such as settling tanks or hydroclones, for further processing of the coal and oil portions separately. The fine partially reacted coal particles remaining in the oil following its separation from the coal-oil slurry may provide benefit in the hydrocracking of the heavy fractions of the oil associated with the oil transportation medium. The coal portion containing some heavy oil fractions may be further processed to produce lower boiling liquids and gas, or burned as an improved heavy fuel having reduced sulfur content.

Transporting a coal-oil slurry through existing oil pipelines provides several advantages over pipelines proposed previously for transporting coal-water slurries. For example, there would be no need to build new pipelines to transport coal, and a wide range of concentration of coal in the coal-oil slurry may be used. Also, scarce water resources would not be used and removed from the coal mining region, and there would be no difficulties associated with treating and reclaiming water at the pipeline terminal end as would be required for coal-water slurries.

DESCRIPTION OF DRAWING

FIG. 1 is a schematic diagram of a coal-oil pipeline arranged and operated in accordance with the invention.

DESCRIPTION OF PREFERRED EMBODIMENTS

As shown in FIG. 1, a crude oil provided at 10 is introduced under pressure into pipeline 12 at inlet end 12*a*. Also, coal, ground to smaller than about 20 mesh (U.S. Sieve Series) and usually 40–350 mesh at 14, is added to the pipeline at an intermediate location 16 in sufficient amount to provide a transportable coal-oil slurry at 18. The coal preferably contains sulfur less than about 3 weight percent and comprises between about 20 and 60 weight percent of the slurry. The pipeline pressure is increased as needed to overcome fluid friction at one or more pumping stations 20 to produce flow of slurry through the pipeline at velocities which are economic and will provide some turbulence and heating and maintain the coal in suspension in the slurry, such as at least 5 ft/sec and usually 10–50 ft/sec. The combinations of coal particle size, oil viscosity, and flowing velocity needed to maintain the coal particles in suspension in the slurry are generally specified by Stokes Law, and are also taught by U.S. Pat. No. 2,610,900 to Cross. Also if necessary to facilitate maintaining the coal particles in suspension and prevent gel formation, a surfactant such as disclosed by U.S. Pat. No. 4,069,022 to Metzger may be added to the slurry. Pressures in the pipeline should be at least about 50 psig and are usually 200–1000 psig, while slurry temperatures are at least about 350° F. and preferably 400°–600° F. for achieving improved reaction and coal liquefaction.

Pumping stations 20 are spaced as needed along the length of the coal-oil slurry pipeline 18 to maintain the desired flowing conditions. Such conditions in the pipeline are maintained at sufficient pressure and temperature that at least about 5 percent conversion and preferably 10–50 percent conversion of the coal to liquid is achieved, with the remainder of the coal being insoluble in toluene at its boiling point. The coal-oil slurry will remain in pipeline 18 for at least about 15 hours, and preferably for 20–200 hours depending upon the pipeline length and slurry velocity used. Furthermore, when low sulfur coal is preferably used, the sulfur content of the crude oil is reduced by dilution with the liquefied coal fraction which contains lower sulfur concentration than the oil.

At the terminal end of the pipeline 18, the coal-oil slurry can be removed and fed to a catalytic hydrogenation liquefaction process at 22 for further processing to convert the remaining coal fraction to lower boiling liquid products. From this reaction, hydrocarbon gas products are withdrawn at 24 and hydrocarbon liquid products are withdrawn at 26. A similar coal-oil hydrogenation process is disclosed by U.S. Pat. No. 4,054,504 to Chervenak et al. which is incorporated by reference to the extent pertinent.

Alternatively or in addition to feeding the combined coal-oil slurry to a hydrogenation-liquefaction process, the oil portion can be separated from the coal-oil slurry at 30 by settling tanks or other suitable liquid-solids separation devices, such as hydroclones. The oil portion is then passed to refining process operations at 32 to produce desired hydrocarbon liquid products. The remaining coal portion along with some retained heavy oil is passed either to a liquefaction-hydrogenation process 34, such as disclosed by U.S. Pat. No. 4,054,504 for producing hydrocarbon liquid products, or used as fuel such as for a power plant for burning at 36.

This invention will be better understood by reference to the following examples, which should not be construed as limiting its scope.

EXAMPLE 1

Black Mesa bituminous coal ground to have particle size of 93 V % minus 100 mesh, 70 V % minus 200 mesh and 45 V % minus 325 mesh, was slurried with a blended Lloydminster crude oil and charged to a one liter size stirred autoclave to simulate typical conditions encountered in a coal-oil slurry pipeline. Analysis of the coal and oil used are provided in Table 1.

TABLE 1

ANALYSIS OF COAL AND CRUDE OILS USED FOR COAL-OIL SLURRIES

| | Black Mesa Coal | Lloydminster Crude Oil | Alaskan Crude Oil |
|---|---|---|---|
| Moisture, W % | 0.57 | | |
| Gravity, °API | — | 15.7 | 26.6 |
| Carbon, W % | 68.02 | | 86.22 |
| Volatile Material, W % | 41.87 | | |
| Ash, W % | 8.64 | | |
| Hydrogen, W % | 4.90 | | 12.02 |
| Nitrogen, W % | 1.36 | | |
| Sulfur, W % | 0.35 | 3.6 | 1.08 |
| Nickel, ppm | | | 9 |
| Vanadium, ppm | | | 16 |

The autoclave was purged with nitrogen and then pressurized to 100 psig with nitrogen. The autoclave was then heated to desired temperature while stirring the contents at 150 rpm. At the conclusion of each test, a gas sample was taken, the temperature lowered to 150° F. and the pressure reduced to atmospheric.

The resulting coal-oil slurry was diluted with toluene and extracted in a Soxhlet apparatus with toluene to recover all the undissolved coal. In a blank run, it was determined that toluene does not dissolve any coal in such a Soxhlet extraction. The results of the coal-oil pipeline simulated runs made are presented in Table 2 below.

TABLE 2

BLACK MESA COAL SLURRIED WITH LLOYDMINSTER CRUDE OIL

| Run No. | BML-1 | BML-2 | BML-3 | BML-4 | BML-5 |
|---|---|---|---|---|---|
| Coal in Oil, W % | 29.2 | 26.5 | 27.5 | 27.9 | 20.7 |
| Slurry Temperature, °F. | 300 | 400 | 400 | 600 | 600 |
| Duration of Run, Hrs. | 24 | 24 | 160 | 48 | 64 |
| Coal Dissolved, W % | Nil | Nil | 1.4 | 10.0 | 15.8 |

It was observed that practically no coal dissolved below 400° F. temperature. At 600° F. solution of coal in the oil was a function of run duration. The only major constituent found in the gas above the liquid which was not present in a blank run without coal was $CO_2$. This is probably from the decomposition of carboxylic acids in the coal.

EXAMPLE 2

These stirred autoclave experiments were repeated using Black Mesa bituminous coal slurried with Alaskan crude oil per Table 1, with heating and continuous stirring at 150 rpm. At 600° F. temperature the autoclave pressure increased over 100 psig, and to maintain that pressure the autoclave was vented periodically. It was determined that a temperature of 575° F. maintained an equilibrium pressure of 100 psig in the autoclave.

The results of the simulated pipeline runs on a mixture of Black Mesa coal and Alaskan crude oil are presented in Table 3.

TABLE 3

BLACK MESA COAL SLURRIED WITH ALASKAN CRUDE OIL

| Run No. | BMA-1 | BMA-2 | BMA-3 |
|---|---|---|---|
| Coal in Oil, W % | 20 | 20 | 20 |
| Slurry Temperature, °F. | 400 | 600 | 575 |
| Duration of Run, Hrs. | 160 | 40 | 144 |
| Coal Dissolved, W % | Nil | 8.6 | 19.8 |
| Moisture, W % | 0.23 | 0.32 | |
| Hydrogen in Coal, W % | 4.38 | 4.05 | |
| Nitrogen, W % | 1.40 | 1.47 | |
| Sulfur in Coal, W % | 0.38 | 0.39 | |
| Ash, W % | 8.25 | 9.30 | |

Results were similar to those with the Lloydminster crude oil, as essentially no coal dissolved below 400° F. temperature while at higher temperatures the coal solubility was time dependent. Approximately 50 volume percent of the gas above the liquid was $CO_2$. Also, it is noted that the 0.35 weight percent sulfur originally in the coal was increased to 0.38 and 0.39 weight percent, respectively during the run; no sulfur comparison analysis was made of the oil portion.

Although the invention has been generally described in terms of the accompanying diagram and preferred embodiments, it will be appreciated by those skilled in the art that many modifications and adaptions of the basic process are possible within the spirit and scope of the invention, which is defined only by the following claims.

What is claimed is:

1. A process for transporting coal and oil together in slurry form through a pipeline, comprising the steps of:

(a) introducing oil into the pipeline at its inlet end;

(b) adding sufficient coal in particulate form to the oil flowing through the pipeline to provide a transportable coal-oil slurry;

(c) maintaining residence time of said coal-oil slurry for at least about 15 hours and temperature and pressure conditions in the pipeline sufficient for the oil to donate hydrogen to the coal;

(d) maintaining sufficient velocity and flow turbulence of the coal-oil slurry to substantially prevent solids settling in the pipeline and to produce fluid friction heating whereby the coal-oil slurry attains a temperature ranging from about 350° F. to about 600° F. to produce at least partial liquefaction of the coal; and (e) removing the coal-oil slurry from the pipeline at its terminal end.

2. The process of claim 1 wherein the coal is finer than about 20 mesh size (U.S. Sieve Series), contains sulfur less than about 3 weight percent, and the amount of coal in the coal-oil slurry is between about 20 and 60 weight percent.

3. The process of claim 1 wherein the flowing slurry linear velocity exceeds about 5 ft/sec, the slurry temperature exceeds about 350° F., and the slurry residence time in the pipeline is about 20 to about 200 hours, so that at least about 5 weight percent of the coal in the slurry is liquefied.

4. The process of claim 3 wherein the coal is Black Mesa bituminous coal and the slurry temperature is 400° to 600° F.

5. The process of claim 3 wherein the oil is Alaskan crude oil and the slurry temperature is 400° to 600° F.

6. The process of claim 1 wherein a hydrogenation catalyst material in particulate form smaller than about 1/16 inch diameter is added to the coal-oil slurry and transported through the pipeline with the slurry.

7. The process of claim 1 wherein the sulfur content of the oil is reduced during its transit through the pipeline.

8. The process of claim 1 wherein the coal-oil slurry is removed from the pipeline and fed with hydrogen to a catalytic hydrogenation step to gas and further convert the coal fraction to lower boiling liquid products.

9. The process of claim 1 including the further step of removing the coal-oil slurry from the pipeline and separating the remaining particulate coal from the slurry.

10. The process of claim 3 wherein a fine particulate catalyst material having particle size smaller than about 0.020 inch diameter is added to the coal-oil slurry and transported through the pipeline with the slurry, after which the catalyst is retained with the oil portion and fed to a refining process.

11. The process of claim 9 wherein the coal-oil slurry removed from the pipeline is separated into a portion containing principally oil and a portion containing principally coal.

12. The process of claim 11 wherein the coal-oil slurry is fed with hydrogen to a catalytic hydrogenation reaction step to convert the remaining coal fraction to gas and lower boiling liquid products.

13. A process for transporting coal and oil in slurry form through a pipeline, comprising the steps of:

(a) introducing crude oil into the pipeline at its inlet end;

(b) adding sufficient Black Mesa particulate coal finer than about 10 mesh size (U.S. Sieve Series) to the oil flowing through the pipeline to provide a transportable coal-oil slurry;

(c) maintaining velocity exceeding about 5 ft/sec and sufficient flow turbulence of the coal-oil slurry to substantially prevent solids settling in the pipeline and maintaining slurry temperature of 400°–600° F. and residence time exceeding about 15 hours, whereby at least about 5 weight percent of the coal in the slurry is liquefied; and (d) removing the coal-oil slurry from the pipeline at its terminal end.

* * * * *